US006452320B1

(12) United States Patent
New

(10) Patent No.: US 6,452,320 B1
(45) Date of Patent: Sep. 17, 2002

(54) LENS APERTURE STRUCTURE FOR DIMINISHING FOCAL ABERRATIONS IN AN ELECTRON GUN

(75) Inventor: David Arthur New, Mercerville, NJ (US)

(73) Assignees: Sarnoff Corporation, Princeton, NJ (US); Orion Electric Company, LTD, Gumi Kyung-buk (KR)

( * ) Notice: Subject to any disclaimer, the term of this patent is extended or adjusted under 35 U.S.C. 154(b) by 0 days.

(21) Appl. No.: 09/634,505

(22) Filed: Aug. 9, 2000

Related U.S. Application Data

(60) Provisional application No. 60/148,010, filed on Aug. 10, 1999.

(51) Int. Cl.[7] ..... H01J 29/50

(52) U.S. Cl. ..... 313/414; 313/409; 313/412; 315/381; 315/382; 315/382.1

(58) Field of Search ..... 315/381, 382, 315/15, 382.1; 313/409, 414, 415, 416, 441, 444, 446, 447, 448, 449, 452, 453

(56) References Cited

U.S. PATENT DOCUMENTS

| | | | | | |
|---|---|---|---|---|---|
| 4,599,534 | A | * | 7/1986 | Shirai et al. | 313/414 |
| 5,126,625 | A | * | 6/1992 | Cho | 313/414 |
| 5,204,585 | A | * | 4/1993 | Chen | 315/15 |
| 5,241,237 | A | * | 8/1993 | Misono et al. | 313/414 |
| 5,625,252 | A | * | 4/1997 | Tsuzurahara et al. | 313/414 |
| 5,730,887 | A | * | 3/1998 | Simpson et al. | 313/403 |

FOREIGN PATENT DOCUMENTS

| | | | | |
|---|---|---|---|---|
| GB | 2046988 A | | 11/1980 | |
| JP | 04133247 A | * | 5/1992 | H01J/29/50 |
| WO | 90/03042 | | 3/1990 | |

OTHER PUBLICATIONS

PCT International Search Report, Jan. 3, 2001.

* cited by examiner

*Primary Examiner*—Nimeshkumar D. Patel
*Assistant Examiner*—Mariceli Santiago
(74) *Attorney, Agent, or Firm*—William J. Burke

(57) ABSTRACT

A main lens of an electron gun of a cathode ray tube is provided. The main lens for receives a plurality of parallel and co-planar electron beams emitted by the electron gun. The lens focuses each electron beam along a respective one of a plurality of focal axes incident to a display surface. A first grid electrode is positioned substantially orthogonally with respect to the plurality of electron beams, the grid electrode includes a plurality of apertures. Each aperture focuses a respective one of the plurality of electron beams, each aperture is centered about a respective one of said focal axes and has a shape expressed by the equation (1):

$$\left(\frac{x}{a}\right)^{\frac{2}{n}} + \left(\frac{y}{b}\right)^{\frac{2}{n}} = 1 \quad (1)$$

or $$x = a\cos^n\theta;\ y = b\sin^n\theta$$

where a and b define the horizontal and vertical axis lengths, θ is an angle, which varies between 0° and 360°, with respect to the x axis, of a line between the origin (x=0, y=0) and a point on the edge of the aperture and the exponent n determines the deviance from ellipticity, and where 1<n<2. The shape of the plurality of apertures diminishes focal aberrations of the lens.

17 Claims, 9 Drawing Sheets n=1.2 n=1.4 n=1.0 n=1.2 n=1.4 n=1.0 (Standard EA)

n=1.1 n=1.2 n=1.3 n=1.4

Red

Green

LENS APERTURE STRUCTURE FOR DIMINISHING FOCAL ABERRATIONS IN AN ELECTRON GUN

CROSS-REFERENCE TO RELATED APPLICATIONS

This application claims the benefit of U.S. Provisional Application No. 60/148,010, filed Aug. 10, 1999, the contents of which are incorporated herein by reference.

BACKGROUND OF THE INVENTION

The invention relates to an electron gun of a cathode ray tube. More particularly, this invention relates to a main lens of the electron gun for reducing flare, coma and improving the spot shapes of electron beams emitted therefrom.

The main lens structure of a color cathode ray tube (CRT) electron gun generally includes a pair of grid structures for focusing emitted electron beams along desired axes. Generally, the first grid structure has a first electrical potential or "focus voltage," the second grid structure has a second electrical potential or "screen voltage" of the CRT. These grid structures each include a similar pattern of three apertures. The apertures of each grid electrode are substantially aligned and centered about a desired focal axis.

Each aperture of a grid is provided for receiving a corresponding electron beam (red, green, blue) from the electron gun. The grid electrodes are often recessed into a larger common-lens structure, which, while reducing main-lens aberrations, also introduce differences between the focus characteristics of the center (centermost electron beam) and outer guns (outermost electron beam).

Aberrations are key determining factors in assessing electron gun spot performance (i.e, shape of the electron beam point contacting the display surface). In particular, aberrations can lead to spot flare, especially in the horizontal direction where beam sizes are usually the largest. In the outer-gun spots aberrations lead to unbalanced flare, which leaves the spot with a triangular shape.

Known aperture shapes employed by grid electrodes are circular and elliptical. The outer apertures frequently consist of pairs of semi-ellipses, with common heights but differing half-widths. Diamond shaped apertures are also known. Aperture shapes, whether elliptical or diamond shaped are designed with horizontal and vertical dimensions in mind. Since these dimensions are primarily used to set horizontal and vertical focus voltages, known shapes provide little if any control over how the aberration content of the lens varies as a function of angle around the aperture center.

Accordingly, there is a need for a new aperture shape for reducing focal aberrations.

SUMMARY OF THE INVENTION

The present invention comprises a main lens of an electron gun of a cathode ray tube. The main lens receives a plurality of substantially parallel electron beams emitted by a beam-forming region. The lens focuses each electron beam along a respective one of a plurality of focal axes incident to a display surface. A first grid electrode is positioned substantially orthogonally with respect to the plurality of electron beams. The grid electrode includes a plurality of apertures, each aperture focuses a respective one of the plurality of electron beams. Each aperture is centered about a respective one of said focal axes and has a shape expressed by the equation (1):

$$\left(\frac{x}{a}\right)^{\frac{2}{n}} + \left(\frac{y}{b}\right)^{\frac{2}{n}} = 1 \tag{1}$$

or $$x = a\cos^n\theta;\ \ y = b\sin^n\theta$$

where the origin (x=0, y=0) is at the center of the aperture, the x-axis is a line from the center of the aperture to the center of an adjacent aperture and the y-axis is perpendicular to the x-axis. The terms a and b define the horizontal and vertical axis half-widths (distance from the origin to the edge of the aperture), θ is the angle formed with respect to the x axis by a line drawn from the origin to a point on the aperture and ranges from 0° to 360°. The exponent n determines the deviance from ellipticity, where 1<n<2. The shape of the plurality of apertures diminishes focal aberrations of the lens.

In another aspect of the present invention, a main lens of an electron gun of a cathode ray tube is provided wherein differential values of n are used for the two halves of the outer apertures and those halves of n may, in turn, differ from that of the center aperture so that the shape of each aperture reduces main lens focal aberrations.

BRIEF DESCRIPTION OF THE SEVERAL VIEWS OF THE DRAWINGS

The foregoing summary as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used herein for convenience only and is not to be taken as a limitation on the present invention. For example, the term focal aberration is defined as generally referring to such phenomena as flare, coma and similar irregularities in spot shape known to those skilled in the art.

The present invention provides a main lens of an electron gun of a cathode ray tube. The exemplary main lens receives a plurality of substantially parallel and co-planar electron beams emitted by the electron gun. The outer beams may have a slight convergence toward the center beam. The lens focuses each electron beam along a respective one of a plurality of focal axes incident to a display surface. A first grid electrode is positioned substantially orthogonally with respect to the plurality of electron beams. The grid electrode includes a plurality of apertures, each aperture focuses a respective one of the plurality of electron beams. Each aperture is centered about a respective one of said focal axes and has a novel shape as described herein. The shape of the plurality of apertures diminishes focal aberrations of the lens.

Figure 1:
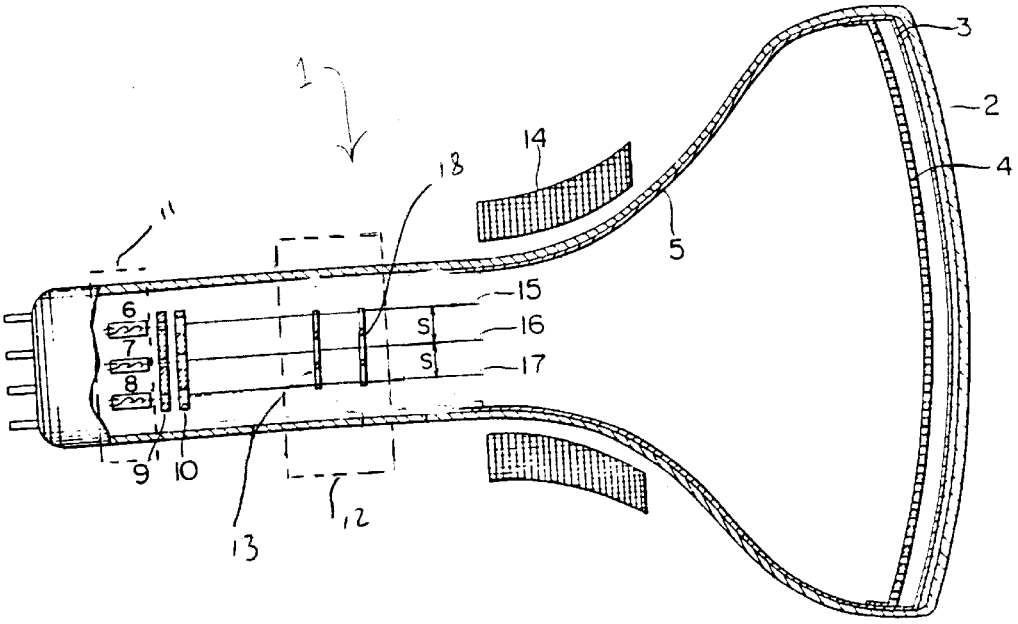
FIG. 1 (PRIOR ART)
FIG. 1 is a horizontal sectional view of a typical prior art color cathode ray tube (CRT)

Referring now more specifically to the drawings, a typical color cathode ray tube (CRT) is shown in FIG. 1. The color CRT, generally designated 1, is a glass envelope which includes a face plate 2 for supporting a flourescent screen 3 on an inner surface thereof. The flourescent screen or "display surface" is coated with three color phosphors one after the other to form striped portions. A beam-forming region 11, including cathodes 6, 7 and 8 provide co-planar and substantially parallel electron beams for passing through corresponding apertures provided in main lens section 12. Although coplanar beams are shown, it is contemplated that the invention may be practiced with other beam configurations, for example, a delta configuration.

The main lens section 12 is positioned substantially orthogonally with respect to the the plurality of electron beams emitted from the beam-forming region 11. The main lens section 12 preferably includes two grid electrode structures 13 and 18. However, it is recognized by those skilled in the art that while main lens section 12 is described as having two grid electrodes, main lens section 12 can employ a plurality of grid electrodes. The grid electrode 13 is energized at an electrical potential defining as a focus voltage, the grid electrode 18 is energized at an electrical potential defined as a screen voltage. Each grid includes a plurality of apertures, each aperture is provided for focusing a respective one of the electron beams emitted from the beam-forming region 11. In the preferred embodiment, a color CRT is utilized, thus three apertures are desired in each grid to correspond to the red, blue and green electron beams of the beam-forming region 11. Similarly, in a color CRT the focus grid electrode 13 has a lower electrical potential with respect to the grid electrode 18 which is kept in equipotential with a conductive coating 5 provided on the inner wall of the CRT 1.

The center of the grid apertures of grid electrode 13 coincide with a respective one of focal axes 15, 16, and 17. The focal axes are disposed on a common plane defined by the x-y axes and are substantially parallel with respect to each other and separated by a distance S. A direction perpendicular to this common plane is hereinafter referred to as the horizontal direction (z-axis in FIGS. 2–7). Grid electrode 18 is positioned between the grid electrode 13 and the display surface 3 to be substantially orthogonal with respect to axes 15, 16 and 17. The apertures of grid electrode 18 correspond to a respective aperture of grid electrode 13 and are substantially aligned therewith. The outer apertures may deviate somewhat from alignment as known to those skilled in the art.

In operation, electron beams emitted from beam-forming region 11 travel along the center axes 15, 16 and 17. The centermost beam, is focused by the main lens section 12 to coincide with focal axis 16. The outermost beams are focused by the main lens 12 to coincide with focal axes 15 and 17. The outermost beams are subsequently forced to converge toward the central beam in an overlapping fashion (i.e., static convergence). The converged integrated beam produces a pattern on the display surface referred to herein after as a "spot," the degree to which a spot varies from a desired focused shape is affected by focal aberrations such as flare (defined as a shape having an abnormally shaped low level portion or lobe) and coma (defined as an unsymetrical spot which is comet shaped). A shadow mask 4 is disposed upon the display surface 3 so that only components for illuminating flourescent materials of colors corresponding to the electron beams pass through openings in the shadow mask and reach display surface 3. A deflection yoke 14 is provided exterior to the CRT 1 for scanning the electron beams on the display surface 3.

Referring now to FIGS. 2–7, the present invention will be described for providing grid electrode aperture shapes that diminish focal aberrations. The mathematical description of the aperture shapes (first quadrant) in accordance with the present invention is shown below as equation (1). If the exponent, n, is equal to 2, the aperture shape is an elongated diamond. If n is equal to 1, the shape is an ellipse as shown in the grid electrodes of FIG. 2. And if n is equal to 0, the shape is a square.

$$\left(\frac{x}{a}\right)^{\frac{2}{n}} + \left(\frac{y}{b}\right)^{\frac{2}{n}} = 1 \tag{1}$$

or $$x = a\cos^n\theta;\ \ y = b\sin^n\theta$$

where a and b define the horizontal and vertical axis half width, x defines a position along the x-axis, y defines a position along the y-axis, θ defines an angle, which varies from 0° to 360°, with respect to the x axis of a line drawn from the origin to a point on the edge of the aperture and the exponent n determines the deviance from ellipticity as n=0 (square), n=1 (ellipse) and n=2 (diamond).

Figure 2:
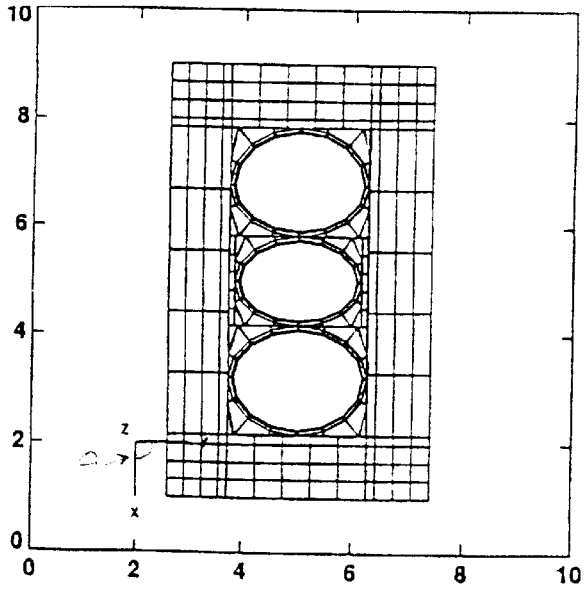
FIG. 2 (PRIOR ART)
FIG. 2 is a front view of a prior art main lens where the aperture variable n=1.0.
Figure 3A:
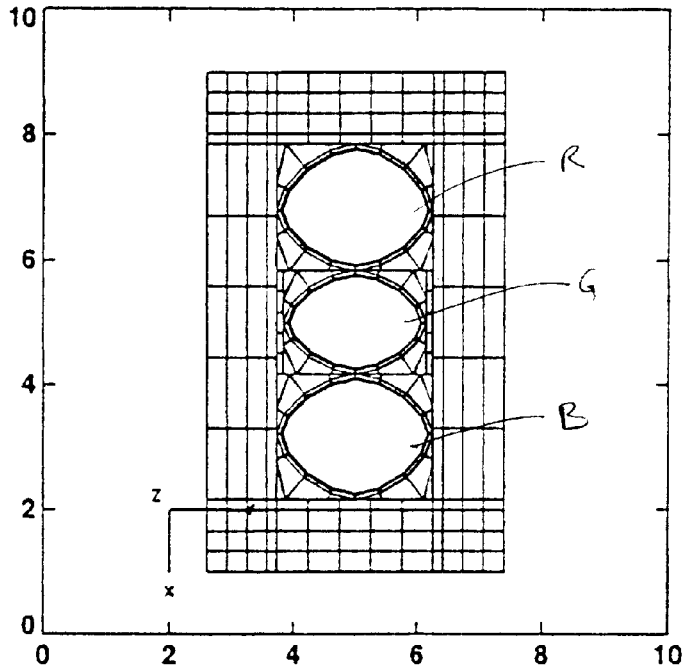
FIG. 3A is a front view of a main lens in accordance with the present invention where the aperture variable n=1.2.
Figure 3B:
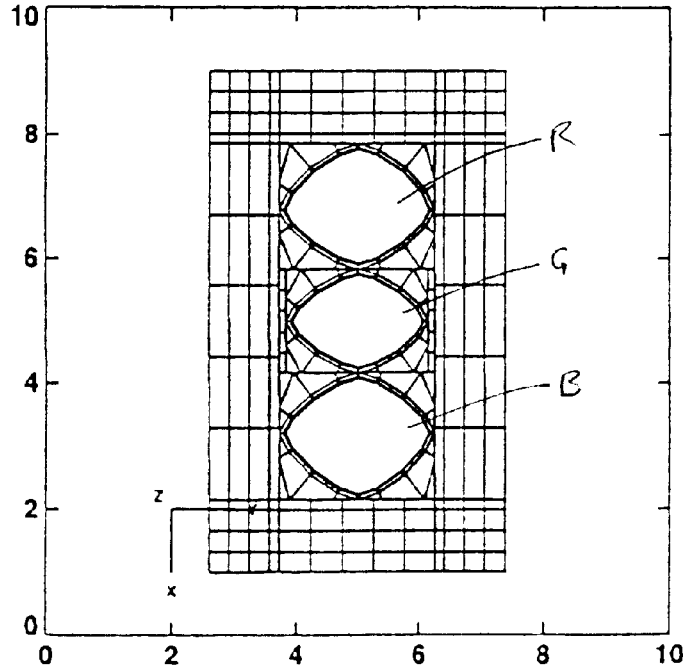
FIG. 3B is a front view of a main lens in accordance with the present invention where the aperture variable n=1.4.

As shown in FIGS. 3A–3B relative to FIG. 2, as the exponent, n, is increased, the amount of grid electrode material between apertures increases. This holds true, even though the width of this bridge of material at its narrowest point will be the same for the various values of n. As a result, the overall mechanical strength of the part will be increased over that of the standard grid electrode employing elliptically shaped apertures.

Figure 4:
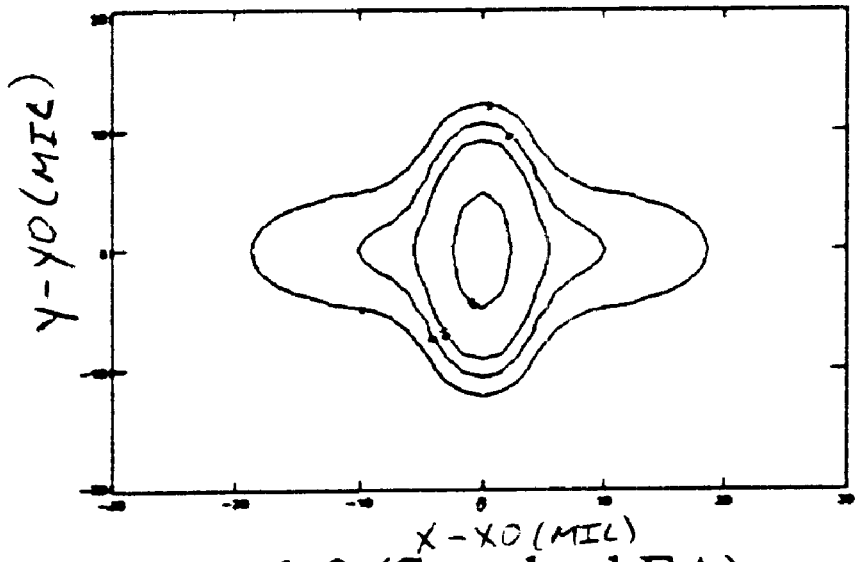
FIG. 4 (PRIOR ART)
FIG. 4 is a typical spot distribution pattern of a prior art elliptical aperture (n=1) in accordance with FIG. 2B.
Figure 5A:
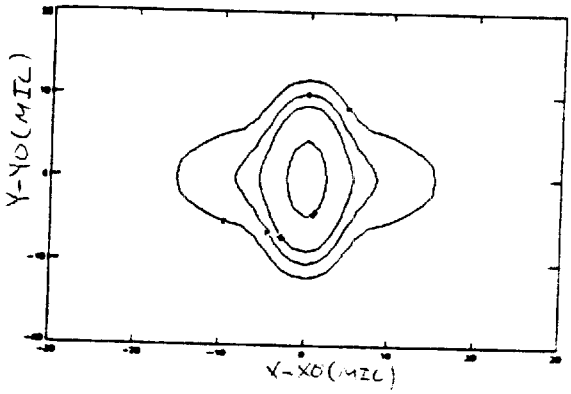
FIG. 5A is a spot distribution pattern in accordance with the present invention (n=1.1)
Figure 5B:
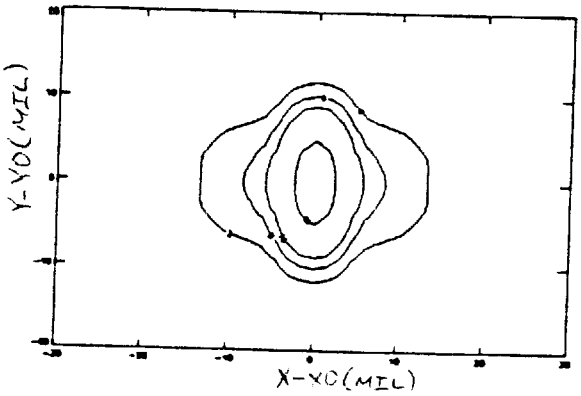
FIG. 5B is a spot distribution pattern in accordance with the present invention (n=1.2) in accordance with FIG. 3A.
Figure 5C:
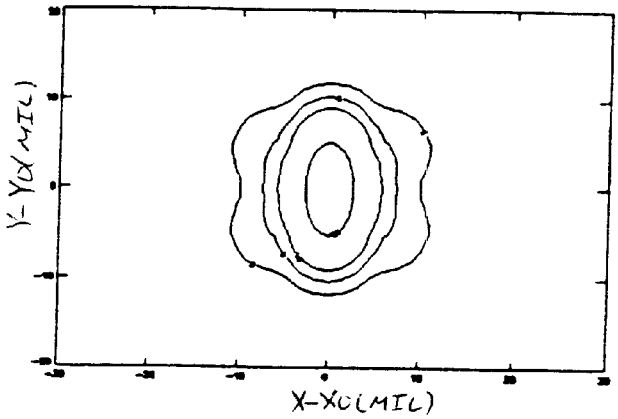
FIG. 5C is a spot distribution pattern in accordance with the present invention (n=1.3)
Figure 5D:
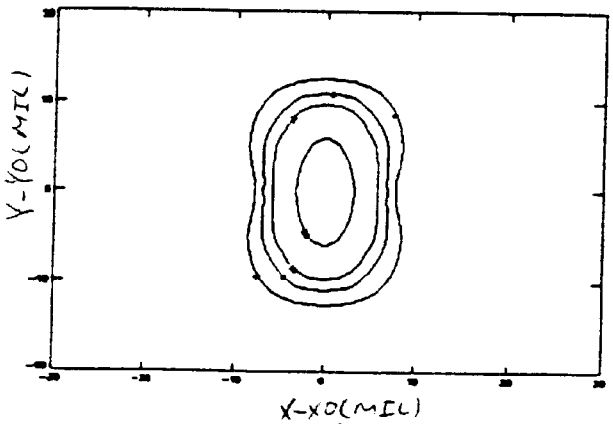
FIG. 5D is a spot distribution pattern in accordance with the present invention (n=1.4) in accordance with FIG. 3B.

As the value of n is increased, the aberration coefficients in the horizontal and vertical directions decrease. At the same time, aberrations along the diagonal directions increase, since the lens size along the diagonals is effectively decreasing. As a result, flare is reduced horizontally, and some of the current density is redistributed to the corners of the spots. Reduced flare and more desirably shaped spots are the result. FIG. 4 shows a spot shape of a prior art grid electrode employing elliptical apertures. Examples of spot shapes for various values of n are shown below in FIGS. 5A–5D. Contour levels of 2%, 5%, 10% and 50% are shown in FIGS. 5A–5D respectively.

As the value of n is increased, the horizontal flare (e.g., 2%) for the 300 $\mu$A spots of FIGS. 5A–5D is greatly reduced at little or no expense approaching the 10% level. The spots also become more squared in shape. The preferred value of n ranges from 1.2 to 1.4.

Figure 6:
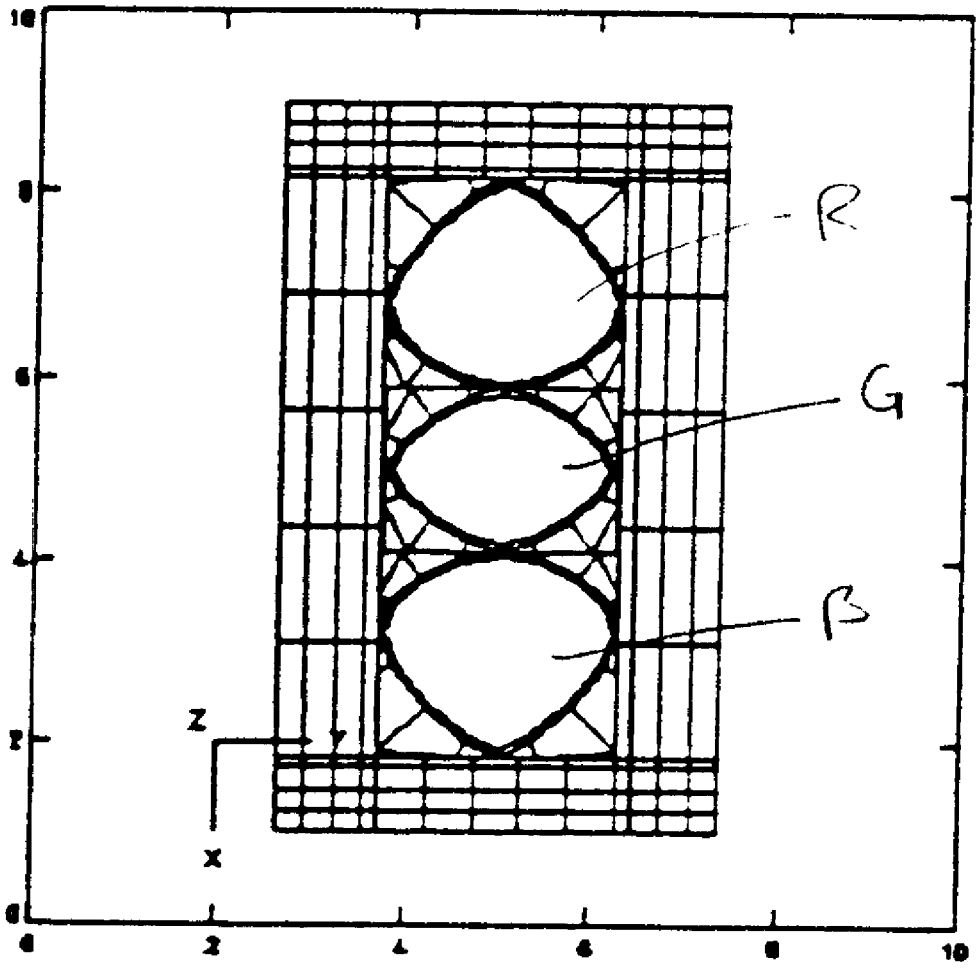
FIG. 6 is a is a front view of a main lens having differentiated centermost and outermost aperture halves in accordance with the present invention.
Figure 7A:
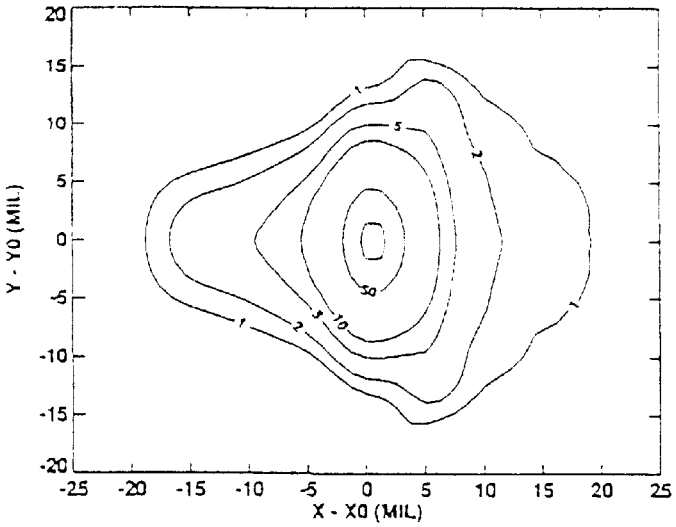
FIG. 7A is a typical red spot distribution pattern of a prior art elliptical aperture (n=1) in accordance with FIG. 2B.
Figure 7B:
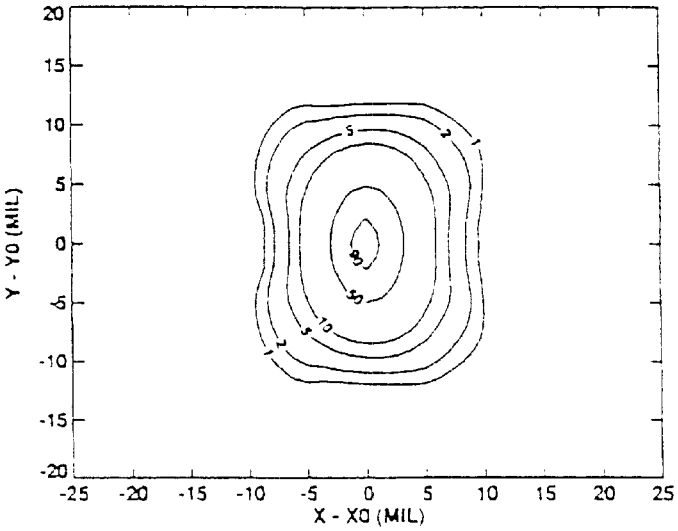
FIG. 7B is a red spot distribution pattern in accordance with the differentiated apertures of FIG. 6 (n=1.25/1.75)
Figure 7C:
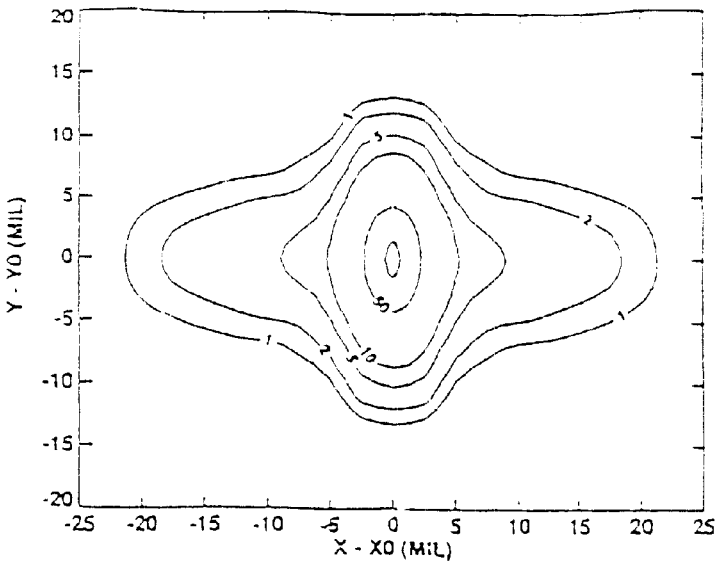
FIG. 7C is a typical green spot distribution pattern of a prior art elliptical aperture (n=1) in accordance with FIG. 2B.
Figure 7D:
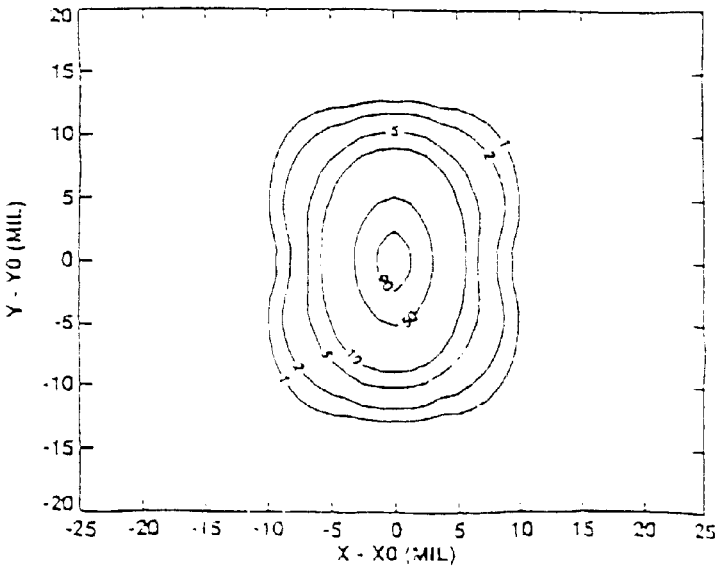
FIG. 7D is a green spot distribution pattern in accordance with the center aperture of FIG. 6 (n=1.3).

Outer gun spots (i.e., outermost apertures for red and green electron beams) often display a left-right asymmetry, and in particular, often display flare pointing inward. Such a spot formed by an elliptical aperture is shown in FIG. 7A. Since the implementation of the non-elliptical aperture shape described above specifically controls horizontal flare and the "squareness" of the spot, it can be expected that using differentiated values of the exponent, n, for the innermost and outermost halves of the apertures would control the asymmetric outer-gun spot distortions noted above. Hence, in an alternative embodiment the outer-gun exponent n (left side outermost aperture), utilizes a different exponent n for inboard and outboard components of the aperture as shown in FIG. 6. The resulting improvement in outer spot size and shape of this embodiment is shown in FIG. 7B where n=1.25 and 1.75. Similarly, for the purpose of further optimizing performance, it is also possible to differentiate exponent values for the focus and anode-grid apertures.

It will be appreciated by those skilled in the art that changes could be made to the embodiments described above without departing from the broad inventive concept thereof. For example, grid apertures in accordance with the present invention have been described with reference to a color CRT, however the lens structure disclosed herein is likewise applicable to monochrome CRT's and/or electron gun based display devices in general. Additionally, it may be desirable to employ the aperture shapes of the present invention on a single grid of a multiple grid main lens section, or to employ diffentiated aperture shapes in accordance with the present invention across the multiple grids. It is understood, therefore, that this invention is not limited to the particular embodiments disclosed, but is intended to cover modifications within the spirit and scope of the present invention.

What is claimed:

1. A main lens of an electron gun of a cathode ray tube, the main lens for receiving an electron beam emitted by the electron gun, the lens focusing the electron beam along a focal axes incident to a display surface, comprising:

a grid electrode positioned substantially orthogonally with respect to the focal axis, the grid electrode including at least one aperture for focussing the electron beam, the aperture being centered about the focal axis and having a shape expressed by the equation (1):

$$\left(\frac{x}{a}\right)^{\frac{2}{n}} + \left(\frac{y}{b}\right)^{\frac{2}{n}} = 1 \tag{1}$$

where x and y define respective horizontal and vertical axis locations in the Cartesian coordinate system where 1<n<2 where a and b define respective horizontal and vertical axis half-widths of the aperture and the exponent n determines a deviance of the aperture from ellipticity, whereby the shape of the at least one aperture diminishes focal aberrations of the lens.

2. A main lens in accordance with claim 1 wherein, $1.2 \leqq n \leqq 1.4$.

3. A main lens in accordance with claim 2 wherein n=1.25.

4. A main lens in accordance with claim 2, wherein n=1.75.

5. A main lens in accordance with claim 1 wherein the electrical potential of the first grid electrode is a focus voltage of the cathode ray tube.

6. A main lens in accordance with claim 1, further comprising:

a further grid electrode between the grid electrode and the display surface so as to be substantially orthogonal with respect to the focal axis, the further grid electrode including at least one further aperture, the at least one further aperture corresponding to at least one aperture of the grid electrode and being substantially aligned therewith.

7. A main lens in accordance with claim 6, wherein the further aperture has a shape expressed by equation (1).

8. A main lens in accordance with claim 7 wherein the electrical potential of the further grid electrode is a display surface voltage of the cathode ray tube.

9. A main lens of an electron gun of a cathode ray tube, the main lens for receiving three parallel electron beams from the electron gun, the lens focusing each electron beam along a corresponding focal axis incident to a display surface, comprising:

a first grid electrode positioned substantially orthogonally with respect to the three electron beams, the grid electrode including three apertures, each aperture corresponding to a respective one of said three electron beams and being substantially aligned therewith, each aperture being centered about a respective one of said focal axes and having a shape expressed by the equation (1):

$$\left(\frac{x}{a}\right)^{\frac{2}{n}} + \left(\frac{y}{b}\right)^{\frac{2}{n}} = 1 \tag{1}$$

where x and y define respective horizontal and vertical axis locations in the Cartesian coordinate system where a and b define respective horizontal and vertical axis half-widths of the aperture and the exponent n determines the deviance of the aperture from ellipticity, where 1<n<2 wherein differential values of n are used for each aperture so that the shape of each aperture reduces main lens focal aberrations for its corresponding electron beam.

10. A main lens in accordance with claim 9 wherein the outermost apertures are substantially congruent in shape.

11. A main lens in accordance with claim 10 wherein each of the outer apertures has an inboard side of an outboard side and, for the inboard side of the outer aperture n=1.25 and for the outboard side of the outer apertures n=1.75.

12. A main lens in accordance with claim 9 wherein the electrical potential of the first grid electrode is a focus voltage of the cathode ray tube.

13. A main lens in accordance with claim 9, further comprising:

a second grid electrode positioned between the first grid electrode and the display surface so as to be substantially orthogonal with respect to the focal axes, the second grid electrode including three further apertures, each further aperture corresponding to a respective one of the three apertures of the first grid electrode and being substantially aligned therewith.

14. A main lens in accordance with claim 13, wherein each of the apertures in the second grid electrode has a shape expressed by equation (1).

15. A main lens in accordance with claim 14 wherein the electrical potential of the second grid electrode is a display surface voltage of the cathode ray tube.

16. A color cathode ray tube, comprising:

an electron gun for providing three parallel and co-planar electron beams to a display surface of the color cathode ray tube;

a first electrode lens for receiving three parallel and co-planar electron beams from the electron gun, the lens focusing each electron beam along a corresponding focal axis incident to the display surface and being positioned substantially orthogonally with respect to the three electron beams, the electrode lens including three apertures, each aperture corresponding to a respective one of said three electron beams and substantially aligned therewith, each aperture being centered about a respective one of said focal axes and having a shape expressed by the equation (1):

$$\left(\frac{x}{a}\right)^{\frac{2}{n}} + \left(\frac{y}{b}\right)^{\frac{2}{n}} = 1 \qquad (1)$$

where x and y define respective horizontal and vertical axis locations in the Cartesian coordinate system where a and b define the horizontal and vertical axis half-widths and the exponent n determines the deviance from ellipticity, where $1<n<2$;

a second electrode lens between the first electrode lens and the display surface so as to be substantially orthogonal with respect to the focal axes, the second electrode lens including three further apertures, each further aperture corresponding to a respective one of the three apertures of the first grid electrode and being substantially aligned therewith, whereby the shape of the plurality of apertures diminishes focal aberrations of the lens.

17. The color cathode ray tube in accordance with claim 16 wherein the electrical potential of the first electrode lens is energized at a focus voltage of the cathode ray tube and the electrical potential of the second electrode lens is energized at a display voltage.

* * * * *